US005845703A

United States Patent [19]

Nir

[11] Patent Number: 5,845,703

[45] **Date of Patent: *Dec. 8, 1998**

[54] HEAT RECOVERY SYSTEM

[76] Inventor: Ari Nir, 2600 Netherland Ave., #3004, Riverdale, N.Y. 10463

[ * ] Notice: The term of this patent shall not extend beyond the expiration date of Pat. No. 5,626,102.

[21] Appl. No.: 817,835

[22] PCT Filed: Mar. 8, 1997

[86] PCT No.: PCT/US97/04561

§ 371 Date: Apr. 11, 1997

§ 102(e) Date: Apr. 11, 1997

[87] PCT Pub. No.: WO97/34107

PCT Pub. Date: Sep. 18, 1997

Related U.S. Application Data

[63] Continuation-in-part of Ser. No. 615,809, Mar. 14, 1996, Pat. No. 5,626,102.

[51] Int. Cl.[6] ..... F22G 1/00

[52] U.S. Cl. ..... 165/140; 122/7 R

[58] Field of Search ..... 165/140; 122/7 R

[56] References Cited

U.S. PATENT DOCUMENTS 573,111 12/1896 Shepard ..... 165/140

686,313 11/1901 Mann ..... 165/140

*Primary Examiner*—Noah P. Kamen

*Attorney, Agent, or Firm*—Ilya Zborovsky

[57] ABSTRACT

A heat recovery system has with a first tube bundle for circulating a first fluid, a second tube bundle for circulating a second fluid, and a shell which accommodates the tube bundles arranged in the shell, so that when a third fluid is circulated through the shell it contacts the tube bundles for a heat transfer between the third fluid and the two first-mentioned fluids, to provide a heat transfer between three fluids.

12 Claims, 12 Drawing Sheets

HEAT RECOVERY SYSTEM

This application is a continuation in part application of application Ser. No. 08/615,809, filed Mar. 14, 1996 now U.S. Pat. No. 5,626,102.

TECHNICAL FIELD

The present invention relates to a heat recovery system. More particularly, it relates to a heat recovery system for a heat transfer between fluids.

BACKGROUND ART

Heat recovery systems of the above mentioned general type are known in the art. In known heat recovery systems one fluid is supplied through a tube bundle arranged in a shell of a heat recovery system, while the other fluid is supplied into the shell of the heat recovery system so that a heat transfer is performed between the two fluids. It is important to increase the heat transfer rate between the fluids.

DISCLOSURE OF THE INVENTION

Accordingly, it is an object of the present invention to provide a heat recovery system which has an improved heat transfer rate between the fluids.

In keeping with these objects and with others which will become apparent hereinafter, one feature of the present invention of the resides, briefly stated, in a heat recovery system which includes two tube bundles for circulation of a first fluid and a second fluid, and a shell which accommodates the tube bundles and through which a third fluid is circulated to be brought into a heat transfer with the first mentioned two fluids, so that a heat transfer between three fluids is performed.

When the heat recovery system is designed in accordance with the present invention, it provides for a substantially increased heat transfer rate between the fluids.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BEST MODE OF CARRYING OUT THE INVENTION

Figure 1:
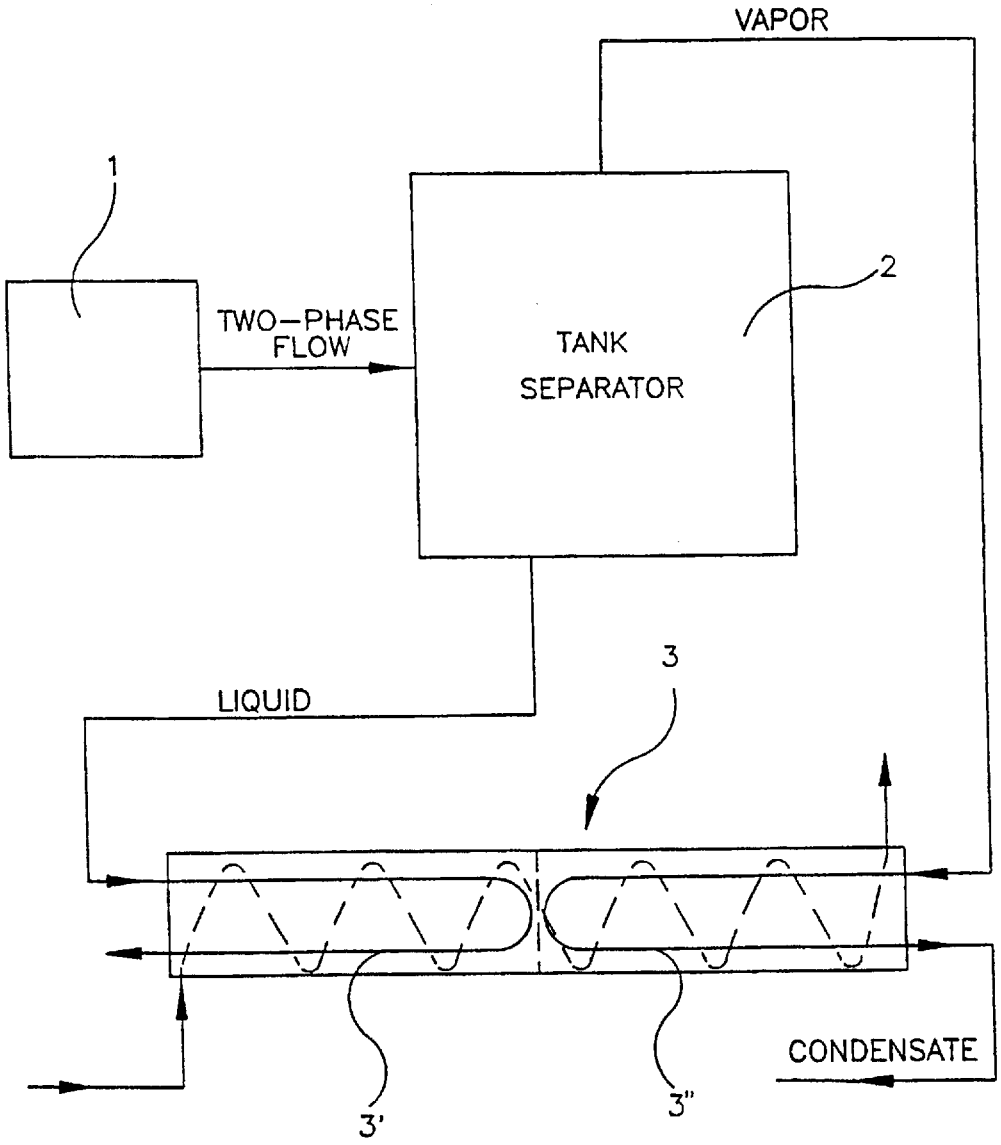
FIG. 1 of the drawings is a view schematically showing a heat recovery system in accordance with the present invention.

A heat recovery system in accordance with the present invention is shown in general in FIG. 1. The system includes a source of a two-phase flow which can be for example a boiler. A tank separator 2 is connected to the source of the two-phase flow, in which the flow is subdivided into two fluids having different phase states, in particular into liquid and vapor. If the source 1 is a boiler, the tank separator 2 subdivides the liquid supplied from the boiler into a blow down water and a flush steam. The system is provided with a shell and two tube bundles identified as a whole with reference numeral 3. The liquid (the blow down water) is supplied from the tank separator into a left part 3' of the heat recovery system which is provided with a first tube bundle, and flows through the tube bundle so as to be discharged at the end, for example into a sewage. The fluid supplied in the left tube bundle can be a fluid which does not change its phase state, and in particular is liquid. The vapor (flush steam) is supplied to a right portion 3" of the heat recovery system provided with a second tube bundle and flows through the second tube bundle in which it condenses. The fluid in the second tube bundle in the right portion 3" of the heat recovery system 3 is a fluid which changes its phase state. A third fluid which is a heated flow and in this case can be a make up water, is supplied into a shell which surrounds both tube portions located in series with one another, so that the heated flow first flows around the left tube bundle located in the left part 3' of the heat recovery system, then flows around the right tube bundle located in the right part 3" of the heat recovery system, and then is withdrawn from the shell. In the example with the heat recovery system from the boiler, the cold flow or the make up water supplied for example with a temperature 40° is heated in the left part 3' of the heat recovery system by heat transfer with the hot blow down water supplied for example with temperature of 230°, so that the make up water is heated for example to 60°. When thereafter the make up water flows in the right part 3" of the heat recovery system and a heat transfer is performed with the condensing flush stream, for example with temperature of 230°, the make up water is heated further.

Figure 2:
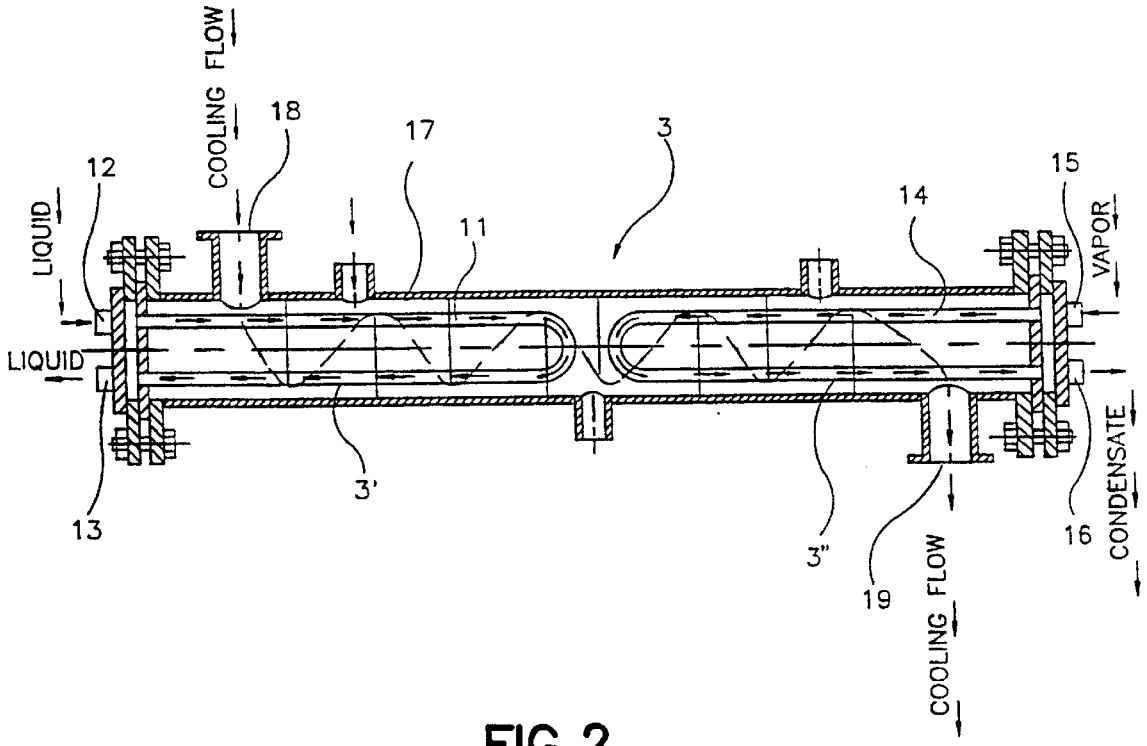
FIG. 2 is a view showing further details of the inventive heat recovery system.

FIG. 2 shows details of the heat recovery system in accordance with the present invention. Here, the left tube bundle is identified as a whole with reference numeral 11 and has a fluid inlet 12 and a fluid outlet 13, the right tube bundle is identified with reference numeral 14 and has a fluid inlet 15 and a fluid outlet 16, and a shell is identified with reference numeral 17 and has a fluid inlet 18 and a fluid outlet 19.

Figure 3:
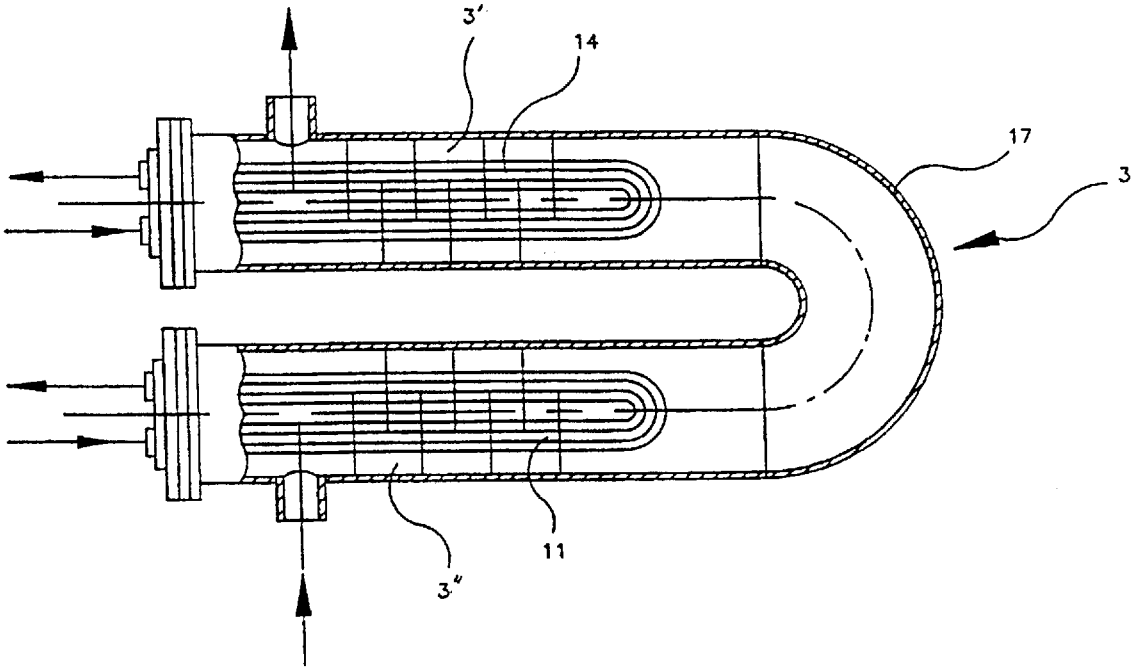
FIG. 3 is a view showing the heat recovery system with a U-shaped shell.

The heat recovery system shown in FIG. 3 has a first tube bundle 11 and a second tube bundle 14 which are arranged one after the other or in other words in series with one another in the parts 3 and 3". The third fluid is circulated through the interior of the shell 17. Here, however, the shell 17 is bent in a U-shaped manner, and the tube bundles 11 and 14 are located in the corresponding legs of the U-shape. In this construction the fluid inlets and outlets of the tube bundles and the shell are located at one side of the heat exchanger, and therefore servicing of the heat recovery system as well as its repair and maintenance are facilitated.

Figure 4:
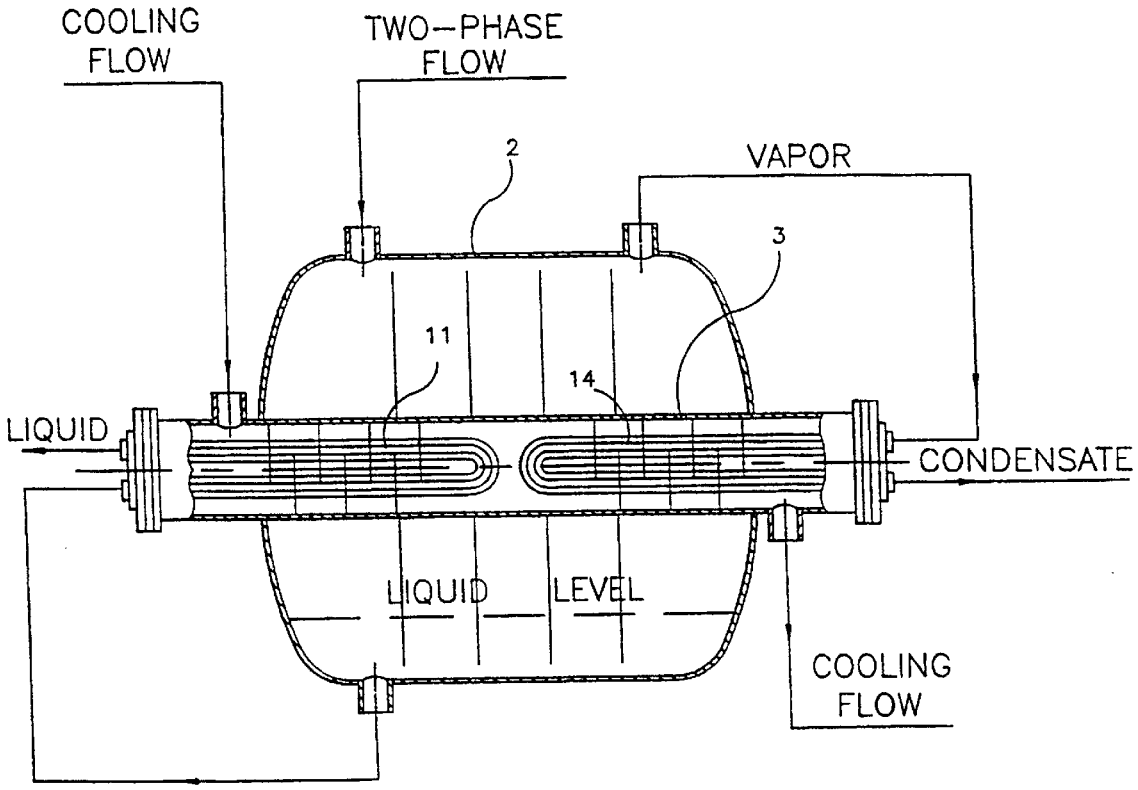
FIG. 4 is a view showing the heat recovery system with the shell and tube bundles located in a tank separator.

The heat recovery system shown in FIG. 4 substantially corresponds to the system of FIG. 2 formed in accordance with the present invention. In this embodiment, however, the shell and the tube bundles are arranged directly in the tank separator 2. This simplifies the overall construction of the heat recovery system of the present invention.

Figure 5:
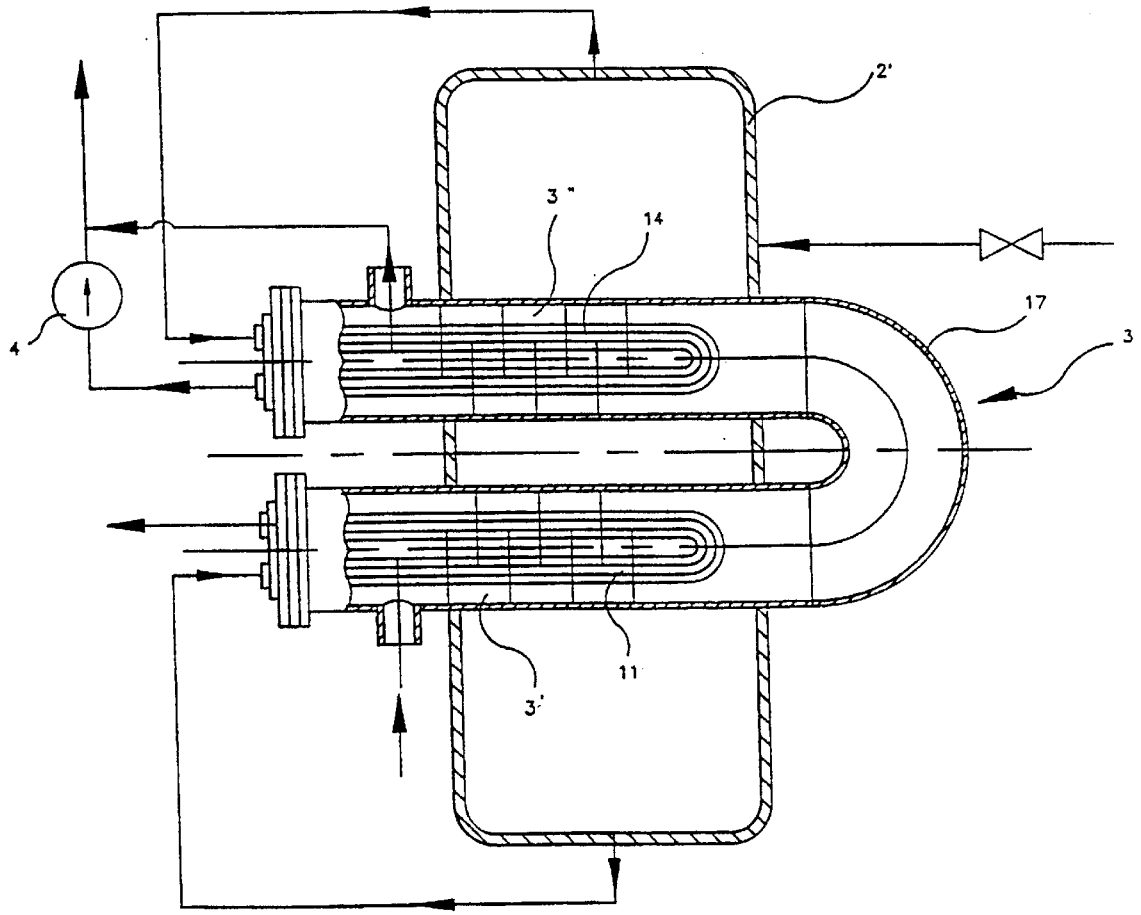
FIG. 5 is a view showing the heat recovery system with a U-shaped shell arranged in a tank separator and with a recirculating pump.

The embodiment of FIG. 5 shows a heat recovery system which combined the features of the heat recovery systems shown in FIGS. 3 and 4. In particular, the shell 17 here is U-shaped and arranged in the tank separator 2'. Also, here a pump 4 is provided for recirculating of the condensate back into a liquid line of this system.

It should be mentioned that the two fluids which are circulated in the two bundles can be fluids of the same chemical substance, for example a water flow and a steam flow. On the other hand, these two fluids can be formed by flows of different chemical substances, for example an ammonia vapor flow and a water flow, etc.

It should also be mentioned that the heat recovery system can be formed as shown in FIG. 2, or alternatingly composed of two sections each including one of the tube bundles, and connected with one another in the middle as shown in broken lines in FIG. 1.

It should be mentioned that the fluid which changes its phase state can be utilized further. In particular, the condensate produced from the vapor in the right tube bundle can be not only discharged, but also can be supplied back to a line leading to the source 1 of the two-phase flow or to another line in the inventive heat recovery system in which the liquid which does not change its phase flows.

Figure 6:
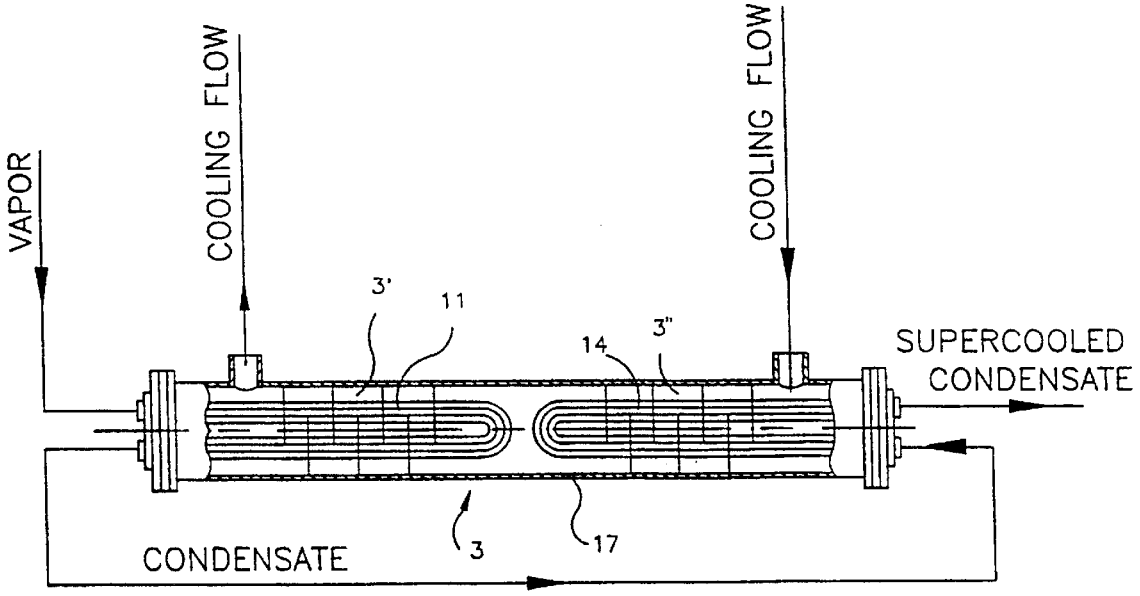
FIG. 6 is a view showing the heat recovery system with a vapor cooled in one tube bundle.

While in the embodiment of FIG. 1 the fluid which passes through the left part 3' of the heat recovery system and does not change its phase state (liquid) and the fluid which passes through the right part 3" of the heat recovery system and changes its phase state (vapor) are produced from the same source, in particular from the two-phase flow, FIG. 6 shows the heat recovery system in accordance with another embodiment. In the heat recovery system shown in this Figure, vapor which is a fluid which changes its phase state, is supplied into the tube bundle 11 arranged in the left part 3' of the heat recovery system. The vapor is condensed in the tube bundle 11 and then as a liquid which does not change its phase state, is supplied into the tube bundle 14 located in the right part 3" of the heat recovery system and is cooled in the tube bundle 14. In all above described embodiments, the third fluid is a cold fluid to be heated by heat recovered from two other fluids. In the embodiment of FIG. 6, similarly to the previous embodiments, the third, cooling fluid is circulated inside the shell 17 so that again it is first brought in a heat transfer with the fluid which does not change its phase state (the condensate), and thereafter is brought into heat transfer with the fluid which changes its phase state (vapor).

Figure 7:
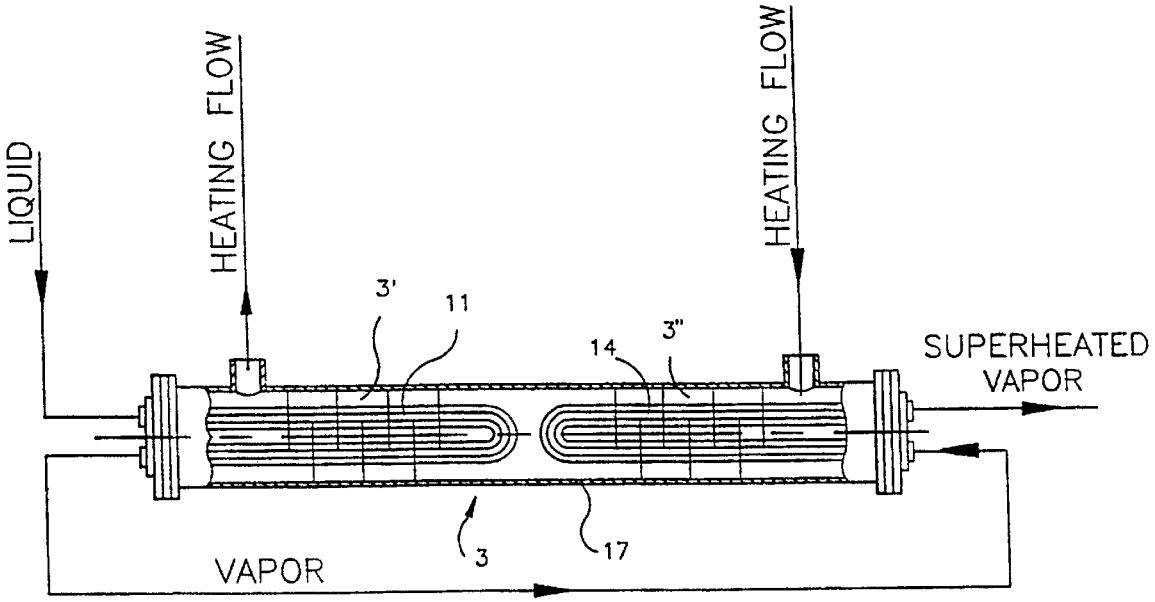
FIG. 7 is a view showing the heat recovery system with a heating fluid circulating inside the shell to heat two other fluids.

In the heat recovery system shown in FIG. 7 the third fluid is a heating fluid which is circulated inside the shell 17 so as to heat the other two fluids and to be cooled. In this heat recovery system the third fluid is brought into a heat transfer first with a fluid which does not change its phase state and thereafter is brought into a heat transfer with a fluid which does change its phase state. An initial flow through the tube bundles is provided by a liquid which is first supplied into the tube bundle 11 located in the left part 3' of the heat exchanger and is heated into the tube bundle 11 to evaporate. The vapor is then supplied into the tube bundle 14 located in the right part 3" of the heat exchanger and is superheated there.

Figure 8:
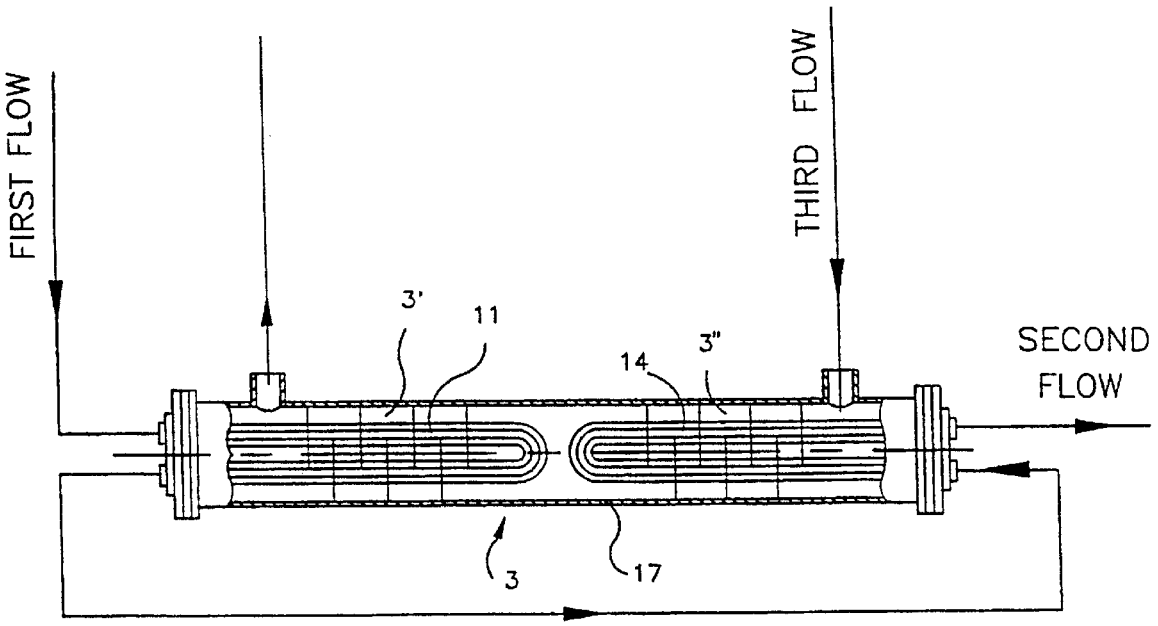
FIG. 8 is a view showing the heat recovery system with a heat exchange between two fluids having the same phase.

In the heat recovery system shown in FIG. 8 the heat exchange is performed between two flows having the same phase. The inlet of the first fluid, which flows from the first tube bundle 11 into the second fluid, is located at one axial end, while the inlet of the third fluid is located at the opposite axial end of the system.

Figure 9:
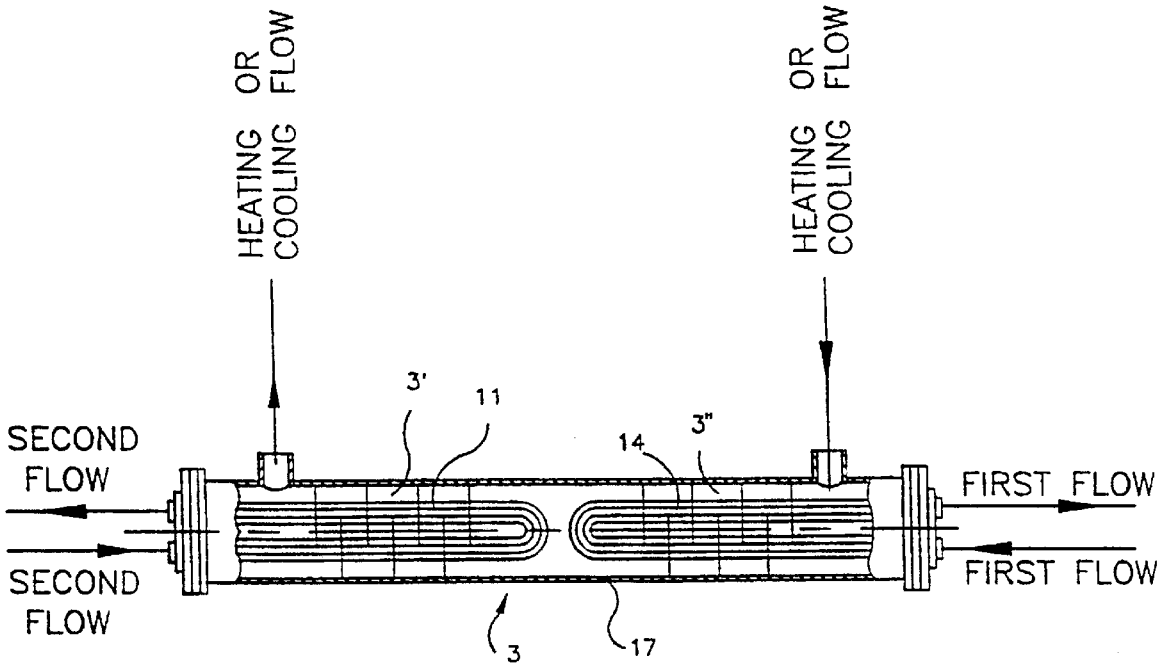
FIG. 9 is a view showing the heat recovery system with independent flows of two fluids.

In the embodiments of FIGS. 9, the first fluid and the second fluids flow independently from one another. The first fluid is supplied into and withdrawn from the tube bundle 14 located in the right part 3" of the heat recovery system, while the second fluid is supplied into and withdrawn from the tube bundle 11 located in the left part 3' of the heat recovery system. The third fluid cools or heats the fluid in one tube bundle and in the other tube bundle.

Figure 10:
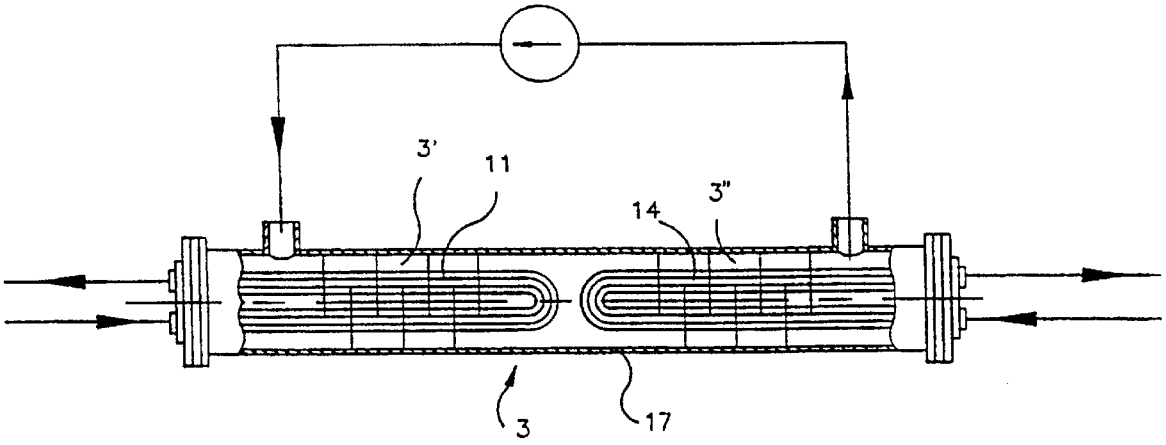
FIG. 10 is a view showing the heat recovery system with a recirculation of a third fluid.

In the embodiment of FIG. 10 the third fluid is recirculated for example, by a recirculating pump to cool the fluid in one bundle and to heat in the other by heat transfer between the fluids in the bundles. Here the heat transfer rates of the first and second tube bundles are substantially equal.

Figure 11:
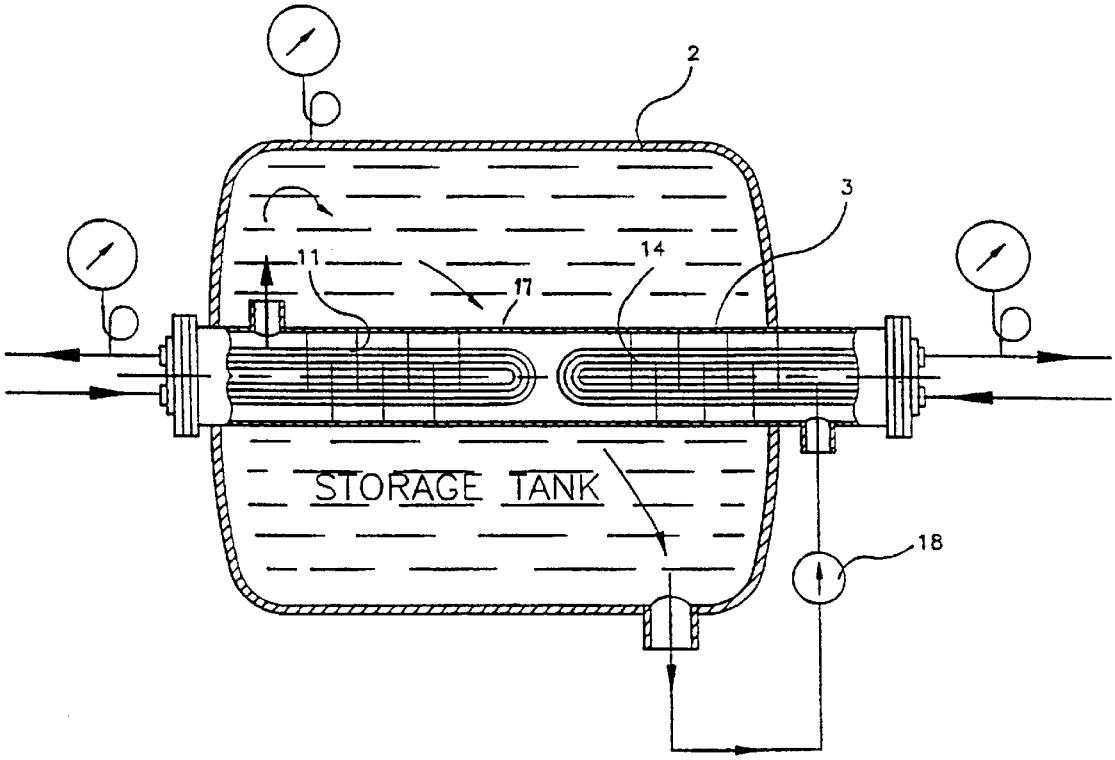
FIG. 11 is a view showing the heat recovery system with coaxial tube bundles arranged in a storage tank; and substantially corresponding to FIG. 11 but having a different circulation.

In the embodiments of FIG. 11 the tube bundles 11 and 14 are arranged coaxially with one another and accommodated in the storage tank 2 of the heat recovery system 3. A circulating device, for example a pump 18 withdraws the third fluid from a right bottom outlet of the storage tank 2 and introduces it into a right inlet of a shell of in the region of the right tube bundle 14. The shell in the region of the left tube bundle 11 has an outlet into the storage tank 2. Therefore, the circulation and storage of the third fluid is provided.

Figure 12:
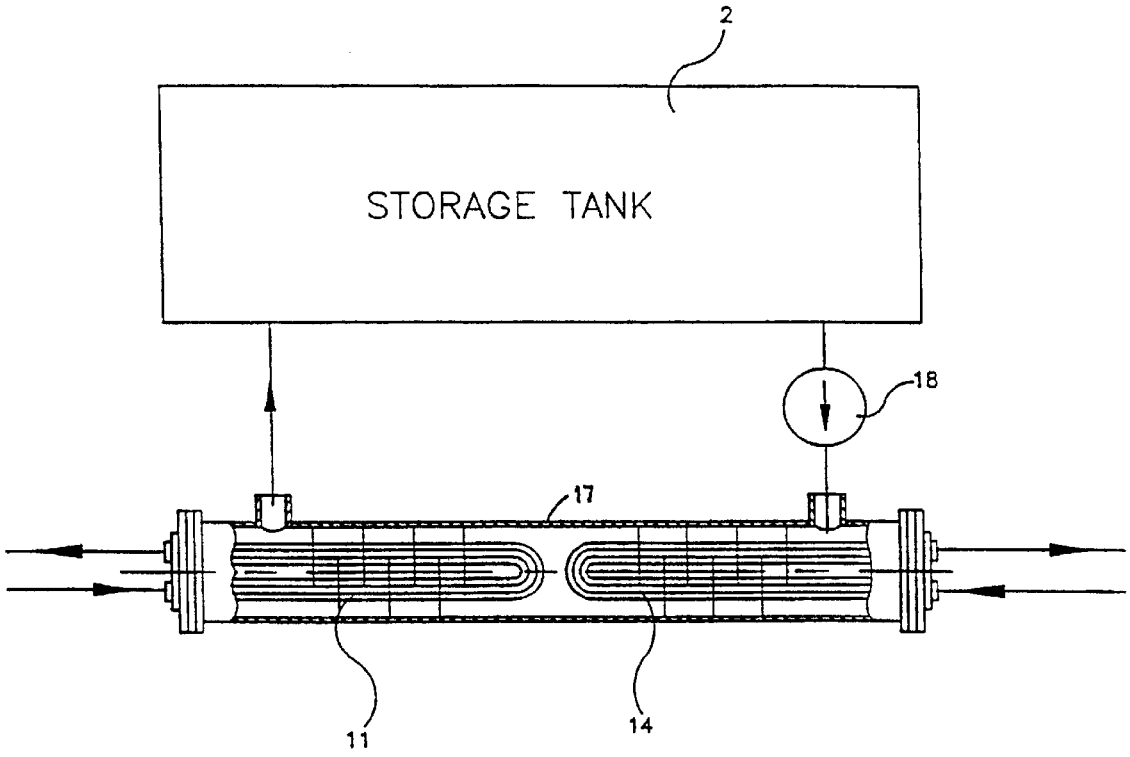
FIG. 12 is a view showing a further embodiment of the invention.

FIG. 12 shows a further embodiment of the heat recovery system of the present invention which is similar to the embodiment of FIG. 11 in the sense of circulation but is somewhat different. The circulator formed for example as the pump 18 withdraws the third fluid from the storage tank 2 and introduces it into the shell in the region of the right tube bundle 14. This fluid passes through the shell and flows through the left outlet of the shell located in the region of the left tube bundle 11 back into the storage tank 2. Thus, the circulation and storage of third fluid is performed here in a somewhat different manner.

In the heat recovery systems, shown in FIGS. 11 and 12 the heat transfer rates of the first and second tube bundles may be not equal while the storage tank serves as an equalizer.

It will be understood that each of the elements described above, or two or more together, may also find a useful application in other types of constructions differing from the types described above.

While the invention has been illustrated and described as embodied in heat recovery system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

I claim:

1. A heat recovery system, comprising a first tube bundle for circulating a first fluid; a second tube bundle for circulating a second fluid; and a shell which accommodates said tube bundles arranged in series in said shell, so that when a third fluid is circulated through said shell it contacts said tube bundles for a heat transfer between said third fluid and a respective one of said two first-mentioned fluids, so as to provide a heat transfer between three fluids; and separating means for separating an initial two-phase flow into said first fluid and said second fluid so as to supply said separated fluid and second fluid into said first tube bundle and said second tube bundle correspondingly.

2. A heat recovery system as defined in claim 1, and further comprising means for connecting said tube bundles with one another for circulation of said two first mentioned fluids.

3. A heat recovery system as defined in claim 1, wherein said shell has an axis and extends substantially in an axial direction and has two axial ends, said tube bundles being arranged in said axial ends of said shell and spaced from one another in an axial direction.

4. A heat recovery system as defined in claim 1, wherein said shell is substantially U-shaped and has two leg portions connected with one another, said tube bundles being arranged in said leg portions and each being provided with a fluid inlet and a fluid outlet located at one side of said shell.

5. A heat recovery system as defined in claim 1, and further comprising circulating means which connect an interior of said shell in a region of one of said tube bundles with an interior of said shell in a region of the other of said tube bundles for circulating said third fluid.

6. A heat recovery system as defined in claim 1, and further comprising tank means; and circulating means arranged to withdraw said third fluid at one location of said shell and introduce the withdrawn third fluid into said shell at another location of said shell, said shell communicating with said tank means.

7. A heat recovery system, comprising a first tube bundle for circulating a first fluid; a second tube bundle for circulating a second fluid; and a shell which accommodates said tube bundles arranged in series in said shell, so that when a third fluid is circulated through said shell it contacts said tube bundles for a heat transfer between said third fluid and a respective one of said two first-mentioned fluids, so as to provide a heat transfer between three fluids; tank means; and circulating means arranged to withdraw said third fluid at one location of said shell and introduce the withdrawn third fluid into said shell at another location of said shell, said shell communicating with said tank means, said shell and said tube bundles being mounted in said tank means.

8. A heat recovery system as defined in claim 7, wherein said tank means are spaced from said shell and said tube bundles; and further comprising conduit means connecting said shell with said tank means and connecting said circulating means with said tank and said shell.

9. A heat recovery system as defined in claim 7, wherein said shell has an axis and extends substantially in an axial direction and has two axial ends, said tube bundles being arranged in said axial ends of said shell and spaced from one another in an axial direction.

10. A heat recovery system as defined in claim 7, wherein said shell is substantially U-shaped and has two leg portions connected with one another, said tube bundles being arranged in said leg portions and each being provided with a fluid inlet and a fluid outlet located at one side of said shell.

11. A heat recovery system as defined in claim 7, wherein said circulating means connect an interior of said shell in a region of one of said tube bundles with an interior of said shell in a region of the other of said tube bundles for circulating said third fluid.

12. A heat recovery system, comprising a first tube bundle for circulating a first fluid; a second tube bundle for circulating a second fluid; and a shell which accommodates said tube bundles arranged in series in said shell, so that when a third fluid is circulated through said shell it contacts said tube bundles for a heat transfer between said third fluid and a respective one of said two first-mentioned fluids, so as to provide a heat transfer between three fluids; tank means; circulating means arranged to withdraw said third fluid at one location of said shell and introduce the withdrawn third fluid into said shell at another location of said shell, said shell communicating with said tank means, said tank means being spaced from said shell and said tube bundles; and conduit means connecting said shell with said tank means and connecting said circulating means with said tank and said shell.

* * * * *